United States Patent [19]

Haas, Jr.

[11] 4,044,179

[45] Aug. 23, 1977

[54] PLAYING SURFACE FOR ATHLETIC GAMES

[75] Inventor: Frederick T. Haas, Jr., Metairie, La.

[73] Assignee: MOD-SOD Sport Surfaces, Metairie, La.

[21] Appl. No.: 632,970

[22] Filed: Nov. 18, 1975

[51] Int. Cl.[2] ..... D03D 27/00; D04H 11/00

[52] U.S. Cl. ..... 428/17; 273/29 R; 273/29 A; 428/87; 428/95; 428/331

[58] Field of Search ..... 428/17, 87, 95, 331; 273/29 R, 29 A

[56] References Cited

U.S. PATENT DOCUMENTS

| | | | |
|---|---|---|---|
| 3,157,557 | 11/1964 | Palmer | 428/17 |
| 3,332,828 | 7/1967 | Faria | 428/17 |
| 3,661,687 | 5/1972 | Spinney | 428/17 |
| 3,740,303 | 6/1973 | Alderson | 428/17 |
| 3,900,656 | 8/1975 | Schmidt | 428/95 |

*Primary Examiner*—Marion E. McCamish

*Attorney, Agent, or Firm*—Schuyler, Birch, Swindler, McKie & Beckett

[57] ABSTRACT

A playing surface for athletic games, such as tennis, comprising a flat, firm subsurface, a pile fabric disposed on the subsurface comprising a relatively flexible, moisture-impermeable backing and normally generally upstanding pile elements resembling grass, a compacted layer of granular mineral material disposed among the pile elements on the backing to a depth from about 75% to substantially equal to the length of the pile elements, the mineral layer comprising less than 10% clay and further comprising a quantity of moisture retaining material sufficient to maintain the moisture content of the mineral layer above about 3% by weight under normal climatic conditions.

10 Claims, 2 Drawing Figures

FIG. 1
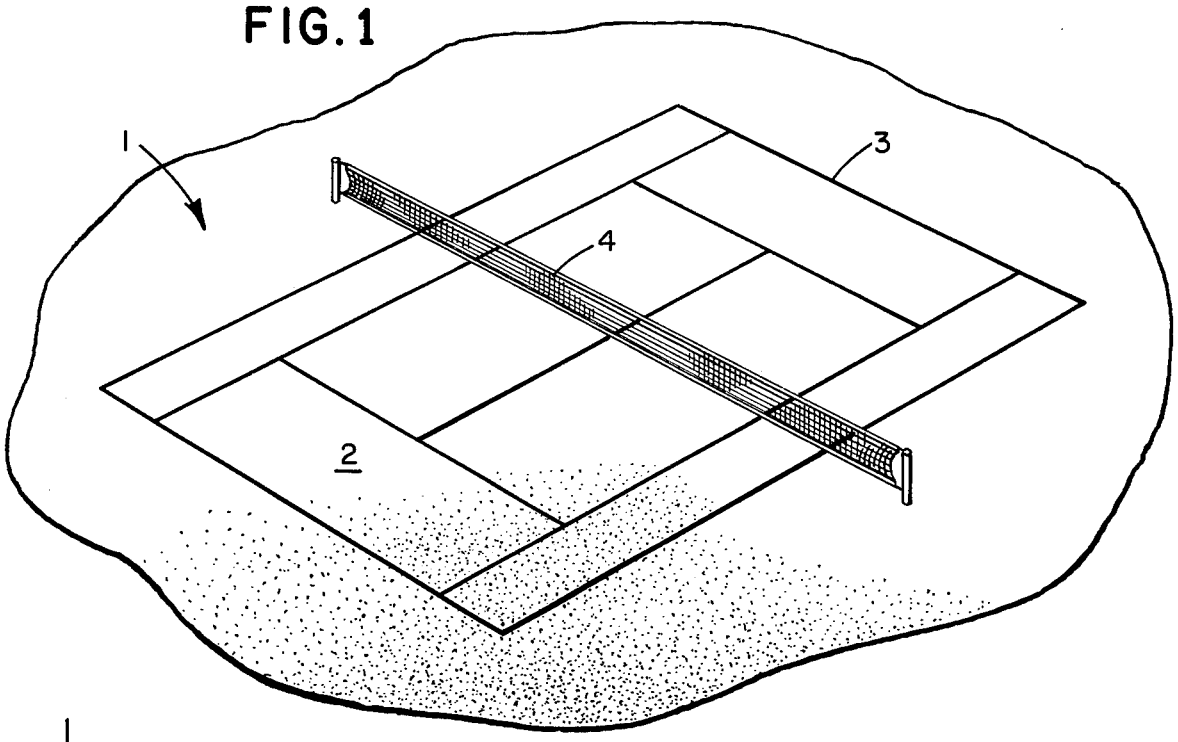
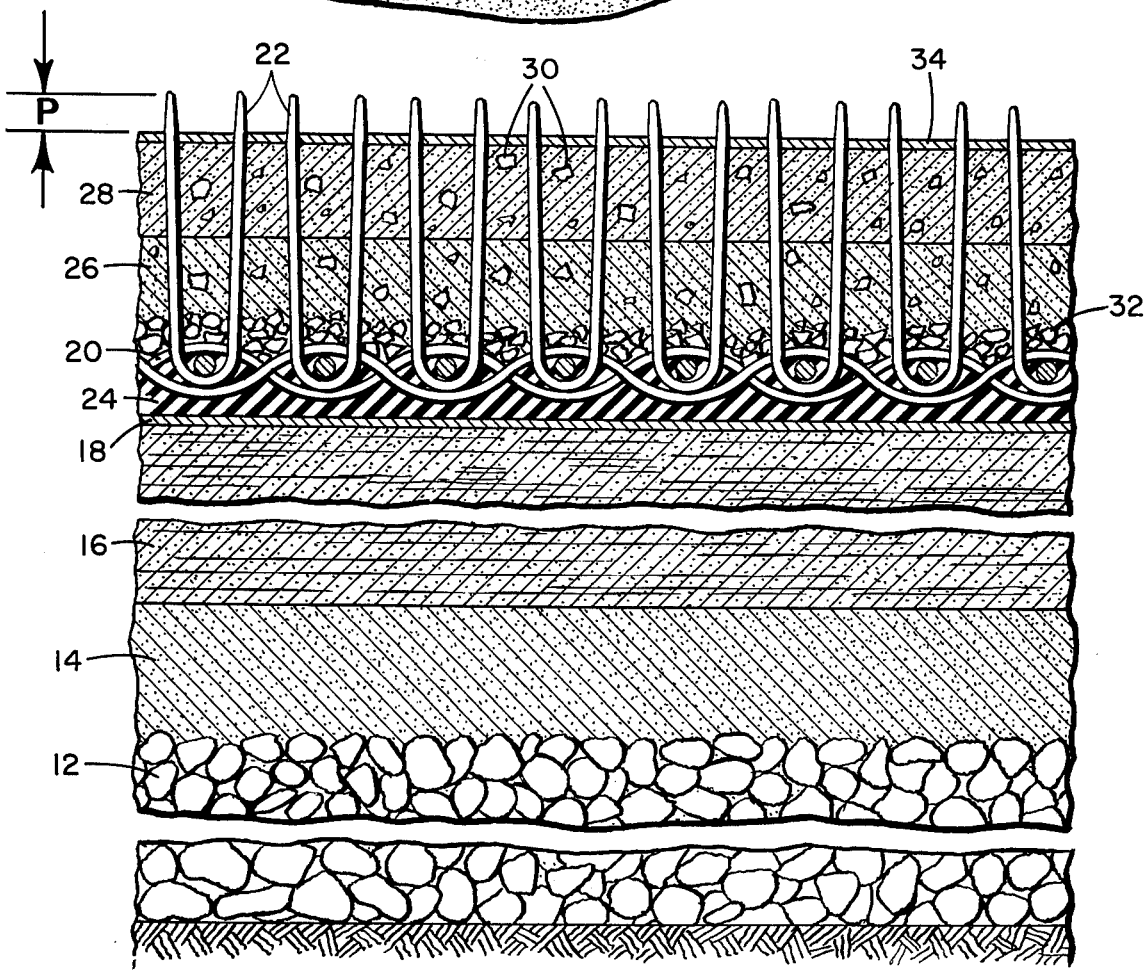
FIG. 2

PLAYING SURFACE FOR ATHLETIC GAMES

BACKGROUND OF THE INVENTION

In recent years the game of tennis has undergone a great world-wide surge in popularity, particularly in the United States. Existing tennis courts are crowded and the demand for construction of new courts is burgeoning.

Tennis courts have been laid out on many types of surfaces including grass, clay or dirt, asphalt or macadam, concrete, wood, linoleum, brick compositions, and synthetic turf. Wood and linoleum are used primarily for indoor courts. Outdoor courts are generally surfaced with concrete, asphalt, clay or grass.

Concrete and asphalt require very little maintenance, but their initial construction costs are very high. Also, the hard, unyielding surfaces of concrete and asphalt courts cause excessive strain to the legs and feet of players.

Clay courts are less expensive to construct than concrete or asphalt courts, but clay courts require a great deal of maintenance. Periodic rolling, as often as daily under heavy usage, is required to keep the surface true. At intervals, additional clay must be added to worn spots and the entire surface carefully releveled. Moreover, clay courts absorb and hold moisture. A wet clay court may become so soggy that every footstep of the players will leave an impression or footprint on the court surface rendering it unfit for play. After heavy rains, days may pass before a clay court drys out to the extent that it is usable.

It is recognized that conventional clay and dirt tennis court surfaces have comprised some sand. However the art has taught that only minor portions of sand were acceptable because sand provides an unstable surface. Surfaces comprising more than about 40% sand were considered to be very poor playing surfaces. While inclusion of sand does help alleviate muddiness, even with the sand, clay courts can remain unusable for 24 to 48 hours after a storm. It has also been known to apply a light dressing of sand to the surface of a clay tennis court when it is to be rolled when damp so that the clay does not stick to the roller, however the art has always cautioned against using more than an absolute minimum of sand. Small amounts of sand have also been advocated as filler materials for the interstices of aggregate surfaces such as macadam, however it has again been emphasized very strenuously that only minimal amounts may be used or the playing surface will be detrimentally affected.

Grass is the epitome of tennis court surfaces. The great championship courts at Wimbledon, England and Forest Hills, New York have traditionally had grass surfaces. For this reason the world's most prestigious tennis organizations are called lawn tennis associations. A good grass court provides the ideal tennis playing surface. However, grass combines the economic disadvantages of hard surface courts and clay courts in that it is expensive to install and requires an excessive amount of maintenance. Also, continuous play on a grass court over a long period of time is not possible because the turf will wear away until large bare patches of earth appear and because of the need of the turf for water and fertilizer. Thus despite the heavy demand for courts, expensive grass courts must stand idle a significant proportion of the time in order to avoid destruction of the grass court surface. The economic disadvantages of grass courts have become so great that tennis experts foresee the time when grass courts will no longer be used at all. Indeed, in 1975 for the first time, the U.S. Open at Forest Hills, New York was played on a clay surface.

Similar problems of expense of installation and maintenance problems of soggy surfaces after rain and excessive wear of turf after periods of more or less continuous use are likewise encountered in grass playing areas of other athletic games such as baseball, soccer or track.

Attempts have been made to use synthetic turf for athletic playing areas including tennis courts. Prior art synthetic turfs have not, however, provided good playing surfaces because they have an unnatural play character due to the springiness of the surface caused by the resilient backing used with such turfs. Conventional artificial turfs also tend to retain water on the surface preventing their use immediately after a rainstorm. Excessive graininess has also been a very troublesome feature of conventional artificial turfs. Graininess occurs because the pile elements of artificial turf are woven into the backing in a regular fashion, and after a period of use the pile elements all tend to lay down in the same direction thereby resulting in a very unnatural bounce for a ball impacting on the surface. Finally, the unnatural footing provided by conventional artificial turfs has been thought to be conducive to falls and resulting player injuries.

OBJECTS OF THE INVENTION

Accordingly, it is an object of the present invention to provide an artificial playing surface for athletic games such as tennis which provides an ideal playing surface, closely resembling the character of the best grass surfaces.

It is another object of the invention to provide an artificial playing surface for athletic games such as tennis which is not prohibitively expensive to construct and maintain.

It is another object of the present invention to provide an artificial playing surface for athletic games such as tennis which is not hard on the feet and legs of players.

It is a further object of the invention to provide an artificial playing surface for athletic games which is suitable for continuous play over a long period of time.

An additional object of the invention is to provide an artificial surface for athletic play which does not remain soggy for a long period of time after a rainstorm.

It is also an object of this invention to provide a playing surface for athletic events suitable for games such as baseball and track.

SUMMARY OF THE INVENTION

These and other objects of the invention are achieved by providing a playing surface for athletic games comprising a substantially flat, firm subsurface; a pile fabric disposed on said subsurface comprising a relatively flexible, substantially moisture-impermeable backing and normally generally upstanding pile elements resembling grass; the length of said pile elements lying in the range from about ½ to about 1½ inches; a compacted layer of weather resistant, granular, mineral material disposed among the pile elements on the backing; the depth of the mineral material lying in the range from 75% to substantially equal to the length of the pile elements and being substantially uniform over the entire area of the playing surface; said mineral material comprising less than 10% clay and further comprising a moisture retaining material sufficient to maintain the moisture content of the mineral material above about 3% by weight under normal climatic conditions. The combination of the pile fabric and the granular material gives rise to a synergistic interaction. The presence of the pile elements within the granular mineral material layers stabilizes the layers and prevents shifting of the granular material. The granular material, in turn, supports each of the projecting tips of the pile elements independently of the backing material so that any tendency of the pile elements to lay down is randomly distributed and graininess is prevented.

BRIEF DESCRIPTION OF THE DRAWINGS

The invention will be further described with reference to the appended drawings wherein:

FIG. 1 is a perspective view of an athletic playing area according to the present invention in the form of a tennis court.

FIG. 2 is a sectional view through an athletic playing area according to the present invention.

DETAILED DESCRIPTION OF THE PREFERRED EMBODIMENTS

FIG. 1 illustrates in perspective a tennis court formed according to the present invention generally designated by reference numeral 1. The artificial turf-like product of the playing surface 2 is marked with lines 3 in the well-known pattern which establishes the inbounds and outbounds singles and doubles playing areas and service courts. A regulation net 4 extends across the middle of the playing area. Playing surface 2 is substantially flat so that a ball striking the surface will bounce "true." The surface of the court is not, however, perfectly level, but instead slopes about 2 inches from one side to the other to provide proper surface drainage and prevent accumulations of water on the playing surface after a rainstorm.

FIG. 2 shows a sectional view through the athletic playing surface of the invention. Construction of the playing area begins by putting down a layer 12 of crushed rock or porous gravel to facilitate subsurface drainage. If desired drain tiles may be included in the crushed rock layer to improve subsurface drainage. Good subsurface drainage is essential where freezing temperatures are encountered in order to prevent heaving and buckling of the surface in freezing weather. The depth of the rock or gravel layer 12 may vary; a depth of from about 2 to about 6 inches is ordinarily satisfactory. The surface of the rock layer is evened out until it is generally level, and the rock or gravel is then covered with an inch or two of sand 14 followed by 3 to 6 inches of clay 16. The surface of clay layer 16 is rolled and smoothed until it is substantially flat. Sufficient side-to-side slope of the surface of the clay layer is provided to insure sufficient surface drainage of the final athletic playing area. For a tennis court, a side-to-side slope of approximately 2 inches along the length of the net is ordinarily sufficient.

The gravel, sand and clay layers comprise a preferred foundation for an athletic playing surface constructed on a site where no previous play surface existed. The essential object is to provide a flat, firm foundation for the artificial turf-like product. Often it may be desired to construct an athletic playing surface according to the invention as a replacement for a previously existing conventional playing surface. Assuming the previous playing area has adequate subsurface drainage and proper slope for surface drainage, a previous area may be used as a foundation for the game playing area of the present invention by merely making sure that the surface is flat and smooth.

Next, a layer of commercial roofing felt 18 is preferably laid down over the foundation surface. The roofing felt layer provides an extra barrier to the transmission of moisture between the artificial turf-like product and the foundation. If desired the felt might be omitted.

A pile fabric 20 which comprises a relatively flexible backing and normally generally upstanding pile elements 22 resembling blades of grass is put down over the felt layer. The pile elements have free ends spaced from the backing providing an upper game playing surface. It is necessary that the backing be substantially moisture-impermeable so that surface moisture will not pass therethrough into the subsurface layers. In FIG. 2 pile fabric 20 is shown as a knitted or woven pile fabric. The pile elements are initially integrally woven or knitted with the backing as high loops at the time the fabric is produced. The loops are subsequently cut to form individual piles with free ends spaced from the backing material. Alternatively the pile elements might be tufted through a preformed backing or they might be flocked onto the backing and secured with a suitable adhesive material. The threads of the pile fabric are preferably a weather resistant material but may comprise any synthetic or natural material used in the manufacture of carpets and the like. It is preferred to use extruded monofilaments of materials such as polyamids, polyesters, olefinic homopolymers or copolymers etc. Ideally the pile elements 22 will be extruded monofilaments of 300 to 1200 denier. Pile elements 22 are uniform in length, the length of the pile elements lying in the range from about $\frac{1}{2}$ to about $1\frac{1}{2}$ inches. For tennis court usage, the length of the pile elements preferably lies in the range from about $\frac{3}{4}$ to about 1 inch. The pile elements, of course, must be flexible. The tips of the pile elements may be tapered if desired to provide for additional flexibility.

In the illustrated embodiment depicted in FIG. 2, the undersurface of pile fabric 20 has been coated with a layer of latex adhesive 24 which helps to secure the pile elements 22 in the matrix of the woven fabric backing and which helps to render the backing resistant to the transmission of moisture therethrough.

After the pile fabric has been laid down over the entire playing area the pile elements are carefully brushed to bring them to an upstanding position. Inert granular mineral material is then applied to the pile fabric to form a compacted layer on the backing interspersed among the pile elements. The mineral material may be conveniently applied by use of a spreader commonly used for dressing natural turf surfaces. Intermittent brushing to keep the pile elements from being matted down during application of the mineral material may be necessary.

Preferably the granular material layer comprises a lower sublayer 26 of fine sand having a particle size lying in the range from 200 U.S. screen mesh size to 40 U.S. screen mesh size and an upper sublayer 28 of medium sand or mixed fine and coarse sand. The depth of the fine sand sublayer is approximately half the height of the pile elements. Medium sand from 20 to 70 U.S. screen mesh size can be used for the upper sand sublayer. Alternatively a mixture of fine 200 to 40 U.S. screen mesh sand and coarse 40 to 12 U.S. screen mesh size sand can be used for the upper sublayer with from 30 to 60 percent of the upper sublayer being course sand.

It would be possible to use a single grade of medium sand for the entire granular material layer, but the use of a lower sublayer of fine sand is preferred because it improves the moisture retention characteristics of the product.

After all of the granular mineral material has been applied to the pile fabric, the top surface of the material is carefully leveled with a sweeper. The distance between the top of the granular mineral material and the tips of the pile elements is denoted in FIG. 2 by the reference letter P and determines the playing characteristics of the athletic playing surface. The top of the mineral material may be substantially even with the tips of the pile elements or the tips of pile elements 22 may project up to ¼ inch above the top of the mineral material. For tennis court applications, it is desired that the pile elements project from 1/32 inch to about 3/16 inches above the top of the sand layer.

After the mineral material has been interspersed among the pile elements and leveled by sweeping, it should be lightly moistened by spraying carefully with a fine spray. For proper playing characteristics, it is essential that the mineral material compact and retain a degree of moisture. If the moisture level of the granular material falls below a minimum of about 3%, excessive dusting will occur. If the moisture level exceeds about 45%, the playing surface will become ever so slightly mushy. Moisture levels in excess of about 45% by weight will not be apparent to a tennis player walking or running on the athletic play area, but it will slightly affect the bounce of a ball impacting on the surface of the playing area. For tennis court applications it is preferred that the moisture level remain between about 5% and about 15% by weight.

In order to provide the necessary moisture retention, particularly in drier climates, a quantity of moisture modifying material particles 30 is incorporated in the mineral material. A preferred moisture modifying material is expanded vermiculite. The vermiculite particles retain moisture and keep the sand layers from becoming too dry. In very arid climates, such as are encountered in the southwestern United States, a thin layer 32 of vermiculite particles may be laid down on the backing material and among the pile elements of the pile fabric before application of the first sand layer. Another substance which can be used as a moisture modifying material is calcium chloride. The amount of moisture retaining material which must be included in the compacted granular mineral material will vary depending on the local climate and seasonal weather conditions.

The sand in the mineral material compacts to form a hard playing surface. It is important that the mineral have a low clay content, less than 10%. Most preferably, the clay content of the sand layers will lie around 1 to 2%. Excessive amounts of clay in the mineral material cause the playing surface to become gooey and damp.

Optionally, the top surface of the granular material may be dressed with a thin layer 34 of a surface modifying material such as surface coloring materials used on rubbico and har-tru surfaces.

The "speed" of a tennis court according to the present invention may be controlled by appropriate selection of the particle size of the top layer of granular material and the distance which the pile elements project above the surface of the granular material. The larger the particle size of the granules at the surface of the mineral material and the shorter the projection of the pile elements 22 above the surface of the granular mineral material, the slower the court will be. A tennis court wherein the granules at the top of the mineral material are about 20 U.S. screen mesh size and the depth of the mineral material is substantially equal to the height of the pile elements would be a comparatively slow court suitable for beginning tennis players or elderly persons. Such a court places a premium on the sustained volley style of play.

On the other hand, a tennis court where the size of the granules at the surface of the mineral material is about 40 U.S. screen mesh size and the pile elements project about 3/16 inch above the surface of the granular mineral material, would be a very fast court comparable to a closely cut grass court. Such a court places a premium on a powerful serve and on net play.

Boundary lines marking the inbounds and outbounds areas and the services areas are merely painted on the surface of the artificial turf-like product.

The playing surfaces of the invention are suitable for indoor or outdoor usage, and may be used for baseball, soccer or track as well as for tennis.

The playing surfaces of the invention require significantly less maintenance than other tennis court surfaces thereby resulting in vastly reduced maintenance expenses. Compared with natural turf courts or clay courts, playing areas constructed according to the present invention are virtually maintenance free. Maintenance of the playing surfaces of the present invention is limited to a periodic gentle brushing or sweeping of the surface with a turf brush or a sweeper and repainting of the boundary lines every year or so. Rolling is ordinarily unnecessary.

The high pile height and the granular material layers of the playing surface of the present invention conduct away excess water and reduce the surface accumulation of water in rainy circumstances thereby preventing the playing surface from becomming soggy and allowing use of the playing areas constructed according to the invention immediately after an ordinary rainstorm without damage thereto.

Furthermore, while use of natural turf tennis courts for more than 1 or 2 hours per day will wear large bare spots in the earth, tennis courts constructed according to the present invention may be used continuously around the clock without undue wear.

It must be remembered that there is a significant synergistic interaction between the pile elements of the synthetic turf and the granular mineral material. The sand supports the pile elements maintaining them in a generally upright position thereby combating the natural tendency of the pile fabric for all of the pile elements to tend to lay down in one direction (often referred to as graininess) due to the regular manner in which the pile elements are attached to the backing. The pile elements in turn stabilize the sand against shifting thereby overcoming the drawback which has prevented active athletic events from being held on sandy surfaces. The shock absorption properties and playing characteristics of the resulting artificial turf-like product are substantially equivalent to those of healthy natural grass turf. Strain on the legs and feet of players are also correspondingly reduced.

The foregoing description has been set forth solely for purposes of exemplification and not as a limitation of the scope of the invention. Since modifications of the described preferred embodiments undoubtedly will occur to others skilled in the art, the scope of the invention is to be limited solely by the scope of the following claims.

I claim:

1. A playing surface for athletic games comprising:

a. a substantially flat, firm subsurface;

b. a pile fabric disposed on said subsurface comprising a relatively flexible, substantially moisture-impermeable backing and normally generally upstanding pile elements resembling grass; the length of said pile elements lying in the range from about ½ to about 1½ inches;

c. A compacted layer of weather-resistant, mineral, granular material disposed among said pile elements on said backing; the depth of said granular material layer lying in the range from about 75% to substantially equal to the length of said pile elements and being substantially uniform over the entire area of said playing surface;

d. said mineral material comprising less than 10% clay and further comprising a quantity of moisture retaining material sufficient to maintain the moisture content of said mineral material above about 3% by weight under normal climatic conditions.

2. A playing surface as recited in claim 1 wherein said level subsurface comprises an underlayer of crushed rock and an overlayer of compacted material selected from the class consisting of sand, clay and mixtures thereof.

3. A playing surface as recited in claim 1 wherein said granular mineral material comprises sand having a particle size lying between 200 U.S. screen mesh size and 12 U.S. screen mesh size.

4. A playing surface as recited in claim 3 wherein said granular mineral material comprises a lower sublayer of fine sand, having a particle size lying in the range from 200 U.S. screen mesh size to 40 U.S. screen mesh size and an upper sublayer of medium sand having a particle size lying in the range from 70 U.S. screen mesh size to 20 U.S. screen mesh size.

5. A playing surface as recited in claim 1 wherein said moisture retaining material comprises expanded vermiculite.

6. A playing surface as recited in claim 1 further comprising a surface modifying material layer on top of said granular mineral material.

7. A playing surface as recited in claim 1 wherein the length of said pile elements lies between about ¾ and about 1 inch and wherein the depth of said granular mineral material lies in the range from about 85% to about 95% of the length of the pile elements.

8. A playing surface as recited in claim 1 wherein the clay content of said granular mineral material lies between about 1 and about 2%.

9. A playing surface as recited in claim 1 wherein said moisture retaining material in said granular mineral material comprises a sublayer disposed adjacent said backing.

10. A playing surface as recited in claim 1 wherein said moisture retaining material is interspersed throughout said granular mineral material.

* * * * *